US011725391B2

(12) United States Patent
Spremulli et al.

(10) Patent No.: US 11,725,391 B2
(45) Date of Patent: Aug. 15, 2023

(54) MODULAR STAIRCASE AND METHOD OF CONSTRUCTING SAME

(71) Applicant: Peter Spremulli, Woodbridge (CA)

(72) Inventors: Peter Spremulli, Woodbridge (CA); Mario Berlingeri, Modena (IT)

(73) Assignee: Peter Spremulli, Woodbridge (CA)

( * ) Notice: Subject to any disclaimer, the term of this patent is extended or adjusted under 35 U.S.C. 154(b) by 0 days.

(21) Appl. No.: 17/880,857

(22) Filed: Aug. 4, 2022

(65) Prior Publication Data

US 2022/0372765 A1 Nov. 24, 2022

Related U.S. Application Data

(62) Division of application No. 16/881,036, filed on May 22, 2020, now Pat. No. 11,441,318.

(30) Foreign Application Priority Data

Jun. 27, 2019 (CA) ..... CA 3048291

(51) Int. Cl.
*E04F 11/02* (2006.01)
*E04F 11/035* (2006.01)
*E04F 11/025* (2006.01)

(52) U.S. Cl.
CPC ..... *E04F 11/035* (2013.01); *E04F 11/025* (2013.01)

(58) Field of Classification Search
CPC ..... E04F 11/035; E04F 11/038; E04F 11/06; E04F 11/025; E04F 11/022; E04F 2011/0209

(Continued)

(56) References Cited

U.S. PATENT DOCUMENTS 29,103 A 7/1860 Roberts
67,328 A 7/1867 McInroy
(Continued)

FOREIGN PATENT DOCUMENTS

AU 2015200568 A1 8/2015
CA 3 115 266 4/2020
(Continued)

OTHER PUBLICATIONS

IStair MPI Concepts, printed from https://www.i-stair.com/ on Sep. 25, 2020, 5 pp.

(Continued)

*Primary Examiner* — Kyle J. Walraed-Sullivan
(74) *Attorney, Agent, or Firm* — Nixon & Vanderhye P.C.

(57) ABSTRACT

A modular staircase frame is lightweight, adjustable, and may be brought to a worksite in pieces to be assembled. The modular staircase frame includes two opposing sets of laterally spaced blades, which may be adjustably connected to form laterally spaced ascending frame members. The opposing sets of blades may include a first pair of blades and a final pair of blades to anchor the frame to a first and second surface, respectively. The blades have openings for adjustable attachment of adjacent blades. The frame may also include stiffeners for added structural support. The opposing sets of laterally spaced blades may further include one or more corner blades for changing the direction of the staircase. Once the frame is installed, treads (temporary or final) can be removably installed on the frame to create a staircase.

17 Claims, 6 Drawing Sheets

(58) Field of Classification Search
USPC ..... 52/182, 188, 191
See application file for complete search history.

(56) References Cited

U.S. PATENT DOCUMENTS

| | | | | |
|---|---|---|---|---|
| 888,882 | A | 5/1908 | Grossman | |
| 947,743 | A | 1/1910 | Steiber | |
| 973,109 | A | 10/1910 | Griner | |
| 1,069,596 | A | 8/1913 | Bladry | |
| 1,256,905 | A | 2/1918 | Kass | |
| 1,257,221 | A | 2/1918 | Grossman | |
| 1,568,568 | A | 1/1926 | Nagin | |
| 2,724,466 | A | 11/1955 | Phillips | |
| 3,039,829 | A | 6/1962 | Onulak | |
| 3,196,997 | A | 7/1965 | Hager | |
| 3,962,838 | A | 6/1976 | Cox | |
| 4,143,740 | A | 3/1979 | Matthews | |
| 4,355,700 | A | 10/1982 | Matthews | |
| 4,422,270 | A * | 12/1983 | Lapointe | E04F 11/1041 52/182 |
| 4,527,366 | A | 7/1985 | Greene | |
| 4,583,334 | A | 4/1986 | Hubbard | |
| 4,586,585 | A | 5/1986 | Zaner | |
| 4,709,520 | A | 12/1987 | Bochatzer | |
| 4,819,391 | A | 4/1989 | Tassin | |
| 4,875,315 | A | 10/1989 | Champagne | |
| 5,369,921 | A * | 12/1994 | Glenn | E04F 11/18 182/113 |
| 5,388,340 | A | 2/1995 | Marty | |
| 5,531,048 | A | 7/1996 | Darling | |
| 5,636,483 | A | 6/1997 | Wille | |
| 5,778,610 | A | 7/1998 | Berg | |
| 5,806,254 | A | 9/1998 | Bennett | |
| 5,899,032 | A * | 5/1999 | Buzby | E04F 11/0255 52/715 |
| 5,983,580 | A | 11/1999 | Carr | |
| 6,088,977 | A | 7/2000 | Lawrence | |
| 6,125,598 | A | 10/2000 | Lanphier | |
| 6,230,454 | B1 | 5/2001 | Meagher | |
| 6,354,403 | B1 | 3/2002 | Truckner | |
| 6,758,016 | B2 | 7/2004 | Gobeil | |
| 7,946,085 | B2 * | 5/2011 | Prins | E04F 11/1041 52/191 |
| 8,091,294 | B2 | 1/2012 | Whalen | |
| 8,833,008 | B2 | 9/2014 | Truckner | |
| 8,887,456 | B2 | 11/2014 | Hyams | |
| 11,085,191 | B2 | 8/2021 | Burt et al. | |
| 2003/0029103 | A1 | 2/2003 | Wack | |
| 2003/0093959 | A1 * | 5/2003 | Couture | E04F 11/1041 52/182 |
| 2004/0040229 | A1 | 3/2004 | Torch | |
| 2005/0236351 | A1 | 10/2005 | Curatolo | |
| 2006/0248817 | A1 | 11/2006 | Elwood | |
| 2006/0272230 | A1 | 12/2006 | Elwood | |
| 2007/0144084 | A1 | 6/2007 | Barry | |
| 2009/0056268 | A1 | 3/2009 | Greenlee | |
| 2009/0151275 | A1 | 6/2009 | Naccarato | |
| 2009/0293385 | A1 | 12/2009 | Vargas | |
| 2010/0287854 | A1 | 11/2010 | Couture | |
| 2011/0067328 | A1 | 3/2011 | Naccarato | |
| 2011/0146169 | A1 | 6/2011 | Ronsheim | |
| 2012/0167494 | A1 | 7/2012 | Brooks | |
| 2016/0002931 | A1 | 1/2016 | Preston | |
| 2017/0356196 | A1 | 12/2017 | Jean | |
| 2020/0109567 | A1 | 4/2020 | Burt et al. | |
| 2021/0355686 | A1 | 11/2021 | Burt et al. | |

FOREIGN PATENT DOCUMENTS

| | | |
|---|---|---|
| DE | 2753345 | 10/1977 |
| JP | 6-180050 | 12/1992 |

OTHER PUBLICATIONS

IStair Demonstration Video on Vimeo, located at https://vimeo.com/57028570, accessed Sep. 25, 2020, 2 pp.

* cited by examiner

MODULAR STAIRCASE AND METHOD OF CONSTRUCTING SAME

CROSS-REFERENCES TO RELATED APPLICATIONS

This application is a divisional of U.S. patent application Ser. No. 16/881,036, filed May 22, 2020, pending, which claims the benefit of Canadian Patent Application No. 3,048,291, filed Jun. 27, 2019, the entire contents of each of which are herein incorporated by reference.

STATEMENT REGARDING FEDERALLY SPONSORED RESEARCH OR DEVELOPMENT

NOT APPLICABLE

TECHNICAL FIELD

The present application relates generally to staircases, and more particularly relates to modular staircases and methods of constructing same.

BACKGROUND

Previously, in order to install a staircase between floors in a home, the staircase was generally fabricated off-site and transported to the home to be installed. The staircase would be bulky and heavy, and would require two or more individuals to bring it to the home, often in a large truck or trailer. In some cases, the staircase would need to be lowered into the house by a crane before the roof is installed. These conventional staircases are particularly difficult to install when a house has three, four, or more floors.

Conventional staircases also require wooden stringers or other structural elements placed between the floors being connected by the staircase in order to anchor the stairs and set the slope of the staircase. The structural element could be the wooden frame behind the drywall of a wall. The requirement for these additional structural elements limits the ability to mass produce staircases for multiple homes, since each staircase needs to be specifically fitted to the home it is being installed into. Also, since the structural elements are wooden, the extended use of the staircase leads to unwanted squeaking and creaking from the structural elements.

The previously known staircases also led to significant expense. Installing a conventional staircase required the use of at least one or two labourers, if not skilled tradespeople such as carpenters. Conventional staircases are also expensive since the finished treads are installed from the outset, and are then exposed to heavy use by contractors and other individuals working on the upper floors of a home during the building process. As a result, these finished treads would often need to be repaired between installation and the house being occupied.

Therefore, there is a need for a lightweight staircase frame that can be easily transported to and assembled at a job site, including a house. There is also a need for a staircase frame that allows for less costly maintenance of the stairs between the construction and occupation of a house.

SUMMARY OF THE DISCLOSURE

The present disclosure provides a lightweight, adjustable modular staircase frame that can be carried in through most normal-sized doorways and easily installed in a home or building. Alternatively, the modular staircase frame may be brought to a worksite in pieces to be assembled. The modular staircase frame of the present disclosure is easier to install than a fully constructed wooden staircase, and can be done by one or two labourers, or even the homeowner alone.

The modular staircase frame is comprised of two opposing sets of laterally spaced blades, which may be adjustably connected to form laterally spaced ascending frame members. The opposing sets of blades may comprise a first pair of blades and a final pair of blades to anchor the frame to a first and second surface, respectively. The blades comprise openings for adjustable attachment of adjacent blades. The frame may also comprise stiffeners for added structural support. The opposing sets of laterally spaced blades may further comprise one or more corner blades for changing the direction of the staircase.

Once the frame is installed, wood (or other material) treads can be removably installed on the frame to create a staircase. Other cladding, such as risers and coverings for the bottom and sides of the frame, can be added for aesthetic purposes. In order to preserve the stairs that the homeowner will eventually use, a set of temporary treads can be installed during the homebuilding process, which can then be replaced by the final set of treads just prior to the homeowner moving in.

According to one aspect, there is provided a modular staircase frame for supporting removable treads in the construction of a staircase, the modular staircase frame comprising: two opposing sets of laterally spaced blades, each set comprising a plurality of adjacent blades being adjustably connected to define an ascending formation relative to an adjacent blade, said two opposing sets of laterally spaced blades defining two laterally spaced ascending frame members, each blade defining a plurality of spaced apart openings adapted to receive a fastener for adjustable attachment to an adjacent blade, said two opposing sets of laterally spaced blades including a first pair of opposing laterally spaced blades each defining a flange for anchoring said first pair of opposing laterally spaced blades to a first surface, and a final pair of opposing laterally spaced blades remote from the first pair of opposing laterally spaced blades, each of said final pair of opposing laterally spaced blades defining a flange for anchoring said final pair of opposing laterally spaced blades to a second surface; and fasteners to adjustably connect each of said adjacent blades together.

According to another aspect, there is provided a modular staircase frame comprising: a pair of laterally spaced first end blades, each first end blade having a plurality of openings for receiving a fastener, the pair of laterally spaced first end blades configured to anchor the frame to a first base surface at a first height and to support a removable first end step; a pair of laterally spaced second end blades that are longitudinally spaced from the pair of first end blades, each second end blade having a plurality of openings for receiving a fastener, the pair of laterally spaced second end blades configured to anchor the frame to a second base surface at a second height and to support a removable second end step; a plurality of pairs of laterally spaced intermediate blades disposed between the first end blades and the second end blades, each intermediate blade having a plurality of openings for receiving a fastener, and each pair of laterally spaced intermediate blades configured to support a removable intermediate step; and a plurality of connecting blades, each connecting blade having at least two spaced openings for receiving a fastener, wherein each first end blade is removably connected to an adjacent intermediate blade by aligning the openings of one of the connecting blades to at least one user-defined opening on the first end blade and at least one user-defined opening on the adjacent intermediate blade, and inserting a fastener through the openings, each second end blade is removably connected to an adjacent intermediate blade by aligning the openings of one of the connecting blades to at least one user-defined opening on the second end blade and at least one user-defined opening on the adjacent intermediate blade, and inserting a fastener through the openings, and each intermediate blade is removably connected to an adjacent intermediate blade by aligning the openings of one of the connecting blades to at least one user-defined opening on each of the adjacent intermediate blades, and inserting a fastener through the openings.

According to another aspect, there is provided a method of constructing a modular staircase frame for supporting removable treads in the construction of a staircase, the method comprising: arranging two opposing sets of laterally spaced blades, each set comprising a plurality of adjacent blades, the two opposing sets of laterally spaced blades further including a first pair of opposing laterally spaced blades and a final pair of opposing laterally spaced blades remote from the first pair of opposing laterally spaced blades, to define two laterally spaced ascending frame members; anchoring the first pair of opposing laterally spaced blades to a first surface; anchoring the final pair of opposing laterally spaced blades to a second surface; and adjustably connecting each of said adjacent blades together to define an ascending formation relative to an adjacent blade.

DETAILED DESCRIPTION

The present disclosure relates to a modular staircase frame and method of constructing same. The modular staircase frame is lightweight, adjustable, and may be brought to a worksite in pieces to be assembled. The modular staircase frame is comprised of two opposing sets of laterally spaced blades, which may be adjustably connected to form laterally spaced ascending frame members. The opposing sets of blades may comprise a first pair of blades and a final pair of blades to anchor the frame to a first and second surface, respectively. The blades comprise openings for adjustable attachment of adjacent blades. The frame may also comprise stiffeners for added structural support. The opposing sets of laterally spaced blades may further comprise one or more corner blades for changing the direction of the staircase. Once the frame is installed, treads (temporary or final) can be removably installed on the frame to create a staircase.

Figure 1:
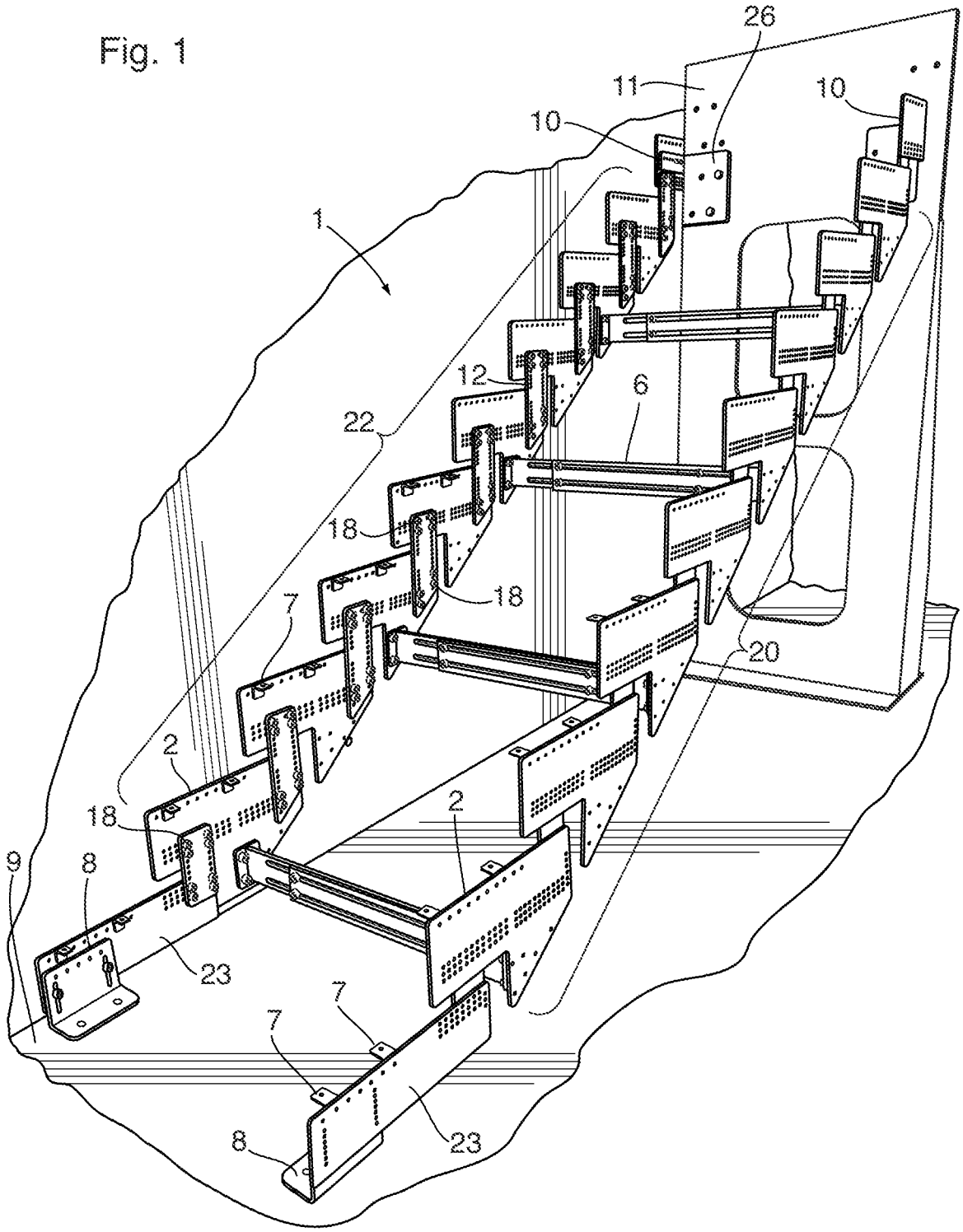
FIG. 1 is a perspective view of the modular staircase frame assembled in accordance with an embodiment of the disclosure.

Referring to FIG. 1, a modular staircase frame 1 is provided in assembled form. Although the frame 1 is shown in assembled form, individual components of the frame 1 may be packaged together or separately for assembly at a worksite, which may include a building site, a house either during construction or after construction has been completed, or any other site where a staircase may be installed. Due to the modular and adjustable nature of the frame 1, as described herein, the same components may be used regardless of the distance between floors being connected by the staircase, and regardless of the desired step height, length, and width.

The frame 1 comprises two opposing sets of laterally spaced blades 20, 22. Each set of laterally spaced blades comprises a plurality of adjacent blades 2 adjustably connected together in an ascending formation. The two opposing sets of laterally spaced blades 20, 22 form the laterally spaced ascending frame members of the modular staircase frame 1. At one end of the two opposing sets of laterally spaced blades 20, 22, there is a first pair of opposing laterally spaced blades 23. Remote from the first pair of opposing laterally spaced blades 23, there is a final pair of opposing laterally spaced blades 10.

As may be seen in FIG. 1, each of the first pair of opposing laterally spaced blades 23 defines a flange 8 for anchoring the first pair of opposing laterally spaced blades 23 to a first surface 9. The flange 8 may be integrally formed with each of the first pair of opposing laterally spaced blades 23, or it may be separately joined. In a preferred embodiment, the first surface 9 may be a horizontal floor, but the skilled person will appreciate that the first surface 9 may be any surface to which a staircase frame could be anchored.

Likewise, each of the final pair of opposing laterally spaced blades 10 defines a flange 26 for anchoring the final pair of opposing laterally spaced blades 10 to a second surface 11. The flange 26 may be integrally formed with each of the final pair of opposing laterally spaced blades 10, or it may be separately joined. In a preferred embodiment, the second surface 11 may be a vertical wall, but the skilled person will appreciate that the second surface 11 may be any surface to which a staircase frame could be anchored.

In a preferred embodiment, the blades 2, 10, and 23 may be made of aluminum, PVC, fiberglass, carbon fiber, plexiglass, polycarbonate, aluminum alloys, or titanium. In a less preferred embodiment, the blades 2, 10, and 23 may be made of steel. In a preferred embodiment, the blades, 2, 10, and 23 are at least ⅜" thick. The blades 2, 10, and 23 may also be symmetrical, so that the same blade could be used for either side of the pair of blades.

Since the two opposing sets of laterally spaced blades 20, 22 form the laterally spaced ascending frame members of the modular staircase frame 1, there is no need to use additional external structural elements, such as stringers or a wall, to support the staircase beyond the frame 1. Accordingly, the modular staircase frame 1 may be used to support a freestanding staircase.

In one embodiment, the two opposing sets of laterally spaced blades 20, 22 may also comprise a plurality of connecting blades 12. These may be interposed between the blades 2 to provide greater adjustability when connecting adjacent blades 2 together, as described below.

Figure 3:
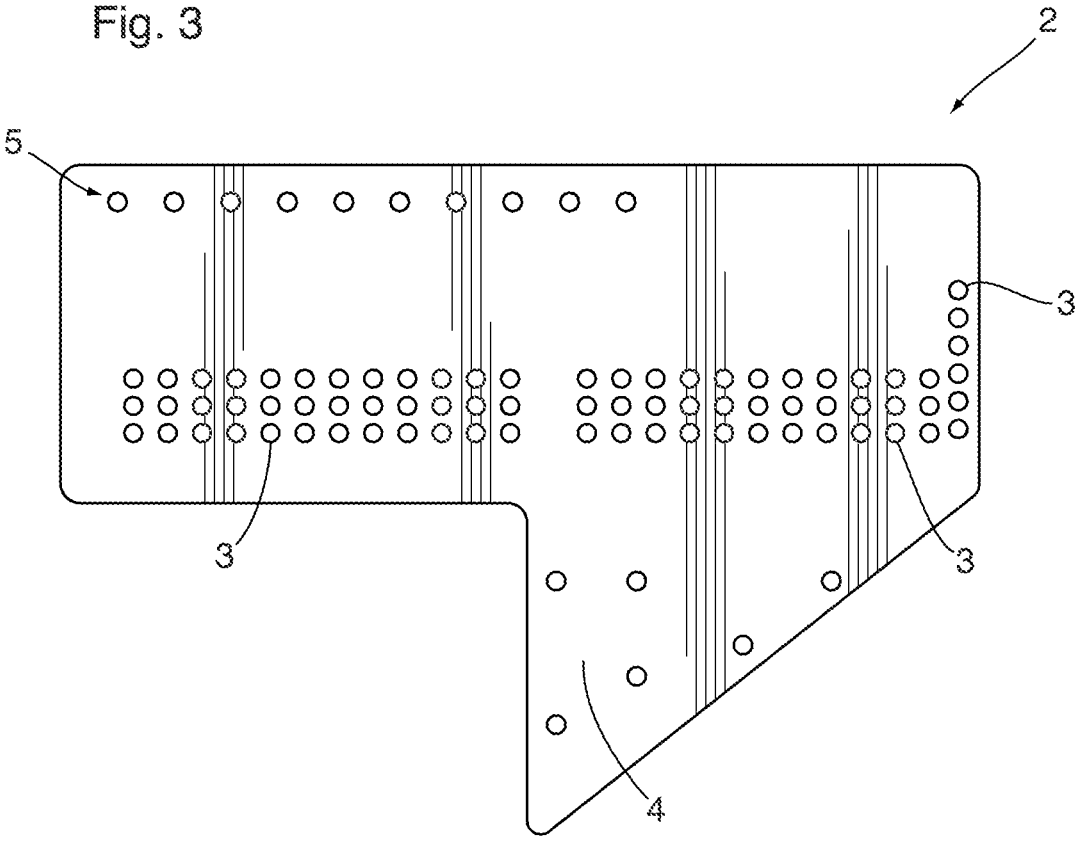
FIG. 3 is a side elevational view of a blade in accordance with an embodiment of the disclosure.
Figure 4:
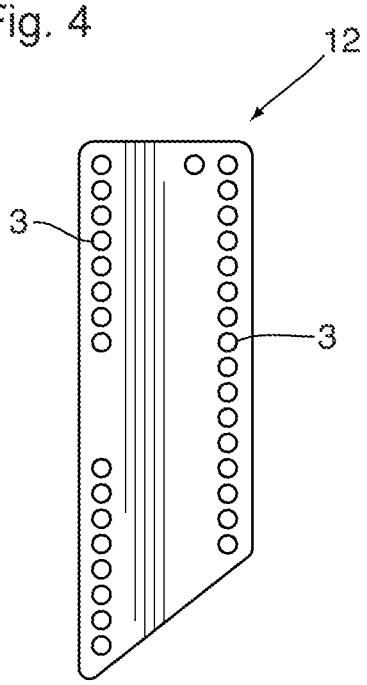
FIG. 4 is a side elevational view of a connecting blade in accordance with an embodiment of the disclosure.
Figure 5:
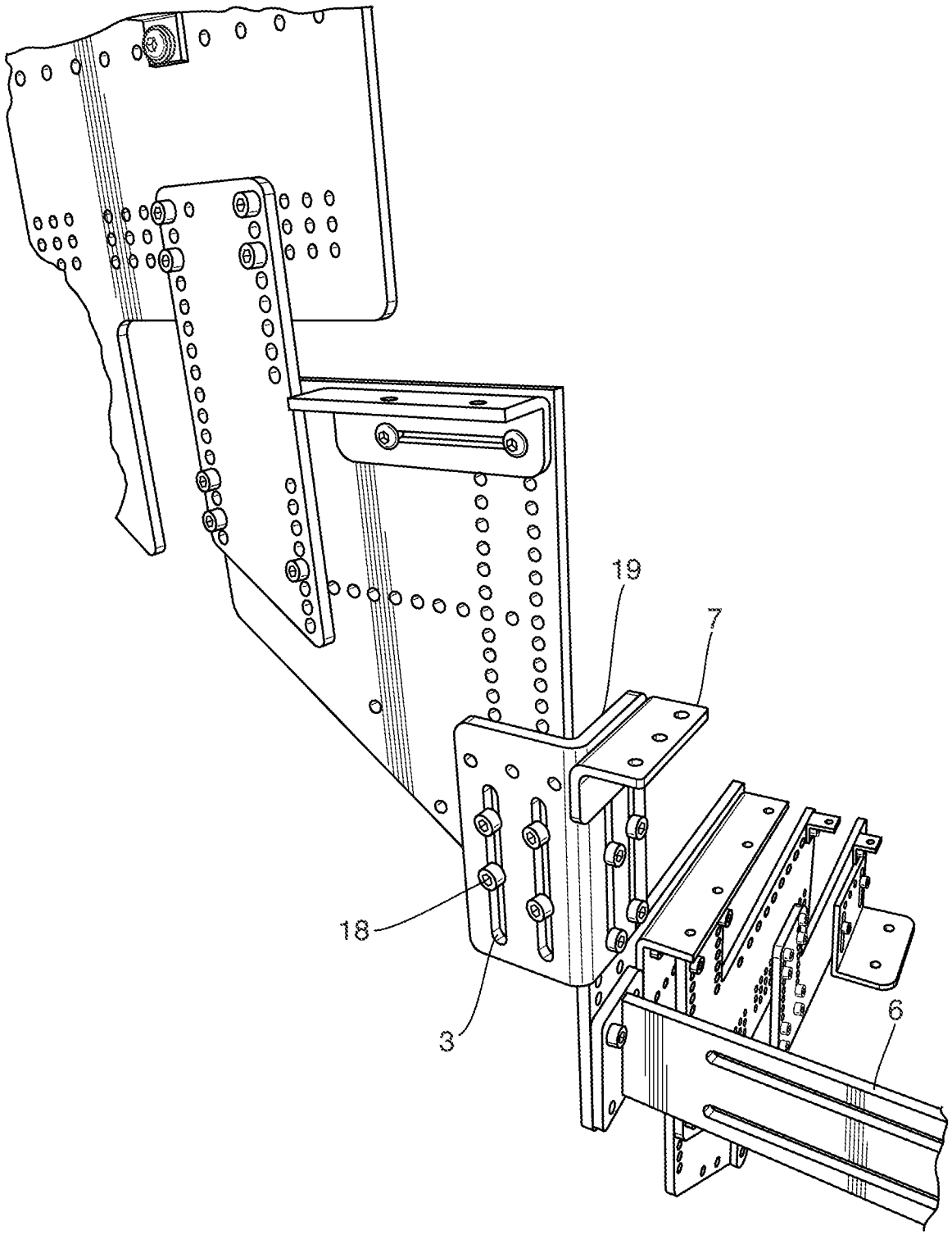
FIG. 5 is a perspective view of a portion of the modular staircase frame assembled in accordance with an alternative embodiment of the disclosure.

As shown in FIGS. 3 and 4, each of the blades 2 and connecting blades 12 have a plurality of spaced apart openings 3 that are adapted to receive a fastener 18. Each of the first pair of opposing laterally spaced blades 23 and the final pair of opposing laterally spaced blades 10 also have a plurality of spaced apart openings 3 that are adapted to receive a fastener 18. The openings 3 may be in the form of holes or channels, as shown in FIG. 5 with reference to corner blade 19.

Due to the number and spacing of the openings 3, adjacent blades 2 may be adjustably attached to each other by selecting the desired opening 3 on each adjacent blade 2 through which the fastener 18 may be inserted, in order to vary the height and distance between adjacent blades 2. Once the appropriate opening 3 is selected on adjacent blades, the openings 3 are aligned and a fastener 18 is removably inserted through the aligned openings 3 to fix the adjacent blades in place in an ascending formation at a desired height and distance. Multiple fasteners 18 may be used to provide added stability to the frame 1.

The modular staircase frame 1 may also comprise stiffeners 6 for added structural support. The blades 2 may have a stiffener fastening portion 4, and the stiffeners 6 may be removably fastened to the blades 2 at the stiffener fastening portion 4. The stiffeners 6 may be fastened to a single pair of blades 2, or to each pair of blades 2, but are preferably fastened to at least every other pair of blades 2, as shown in FIG. 1.

The stiffeners 6 may be of fixed length, but are preferably of adjustable length to vary the spacing between the two opposing sets of laterally spaced blades 20, 22. The stiffeners 6 may comprise a pin-in-slot system to vary the length of the stiffeners 6 and fix them at a preferred length.

As shown in FIG. 1, the blades 2, 10, and 23 may also define a flange 7 for supporting a removable tread, which may be a first end step 14, final end step (not shown), or intermediate step 16. The flange 7 may be integrally formed with the blade 2, 10, and 23, or it may be separately joined.

In the embodiment where the flange 7 is separately joined, it may be a bracket, which may be removably fastened to the bracket fastening portion 5 of the blades 2, 10, and 23. Preferably, at least one bracket is fastened to each blade 2, 10, and 23. More preferably, two brackets are fastened to each blade 2, 10, and 23 at a spaced apart distance to support and removably join the tread to the blade. The brackets may be made of any suitable material, and are preferably ⅛" to ¼" thick.

Since the treads may be removably fastened to the flanges 7, or removably secured to the blades 2, 10, and 23 (including by cutting notches into the treads), a set of temporary treads may be installed while a house is still under construction, to avoid damage to the final set of treads.

Figure 2:
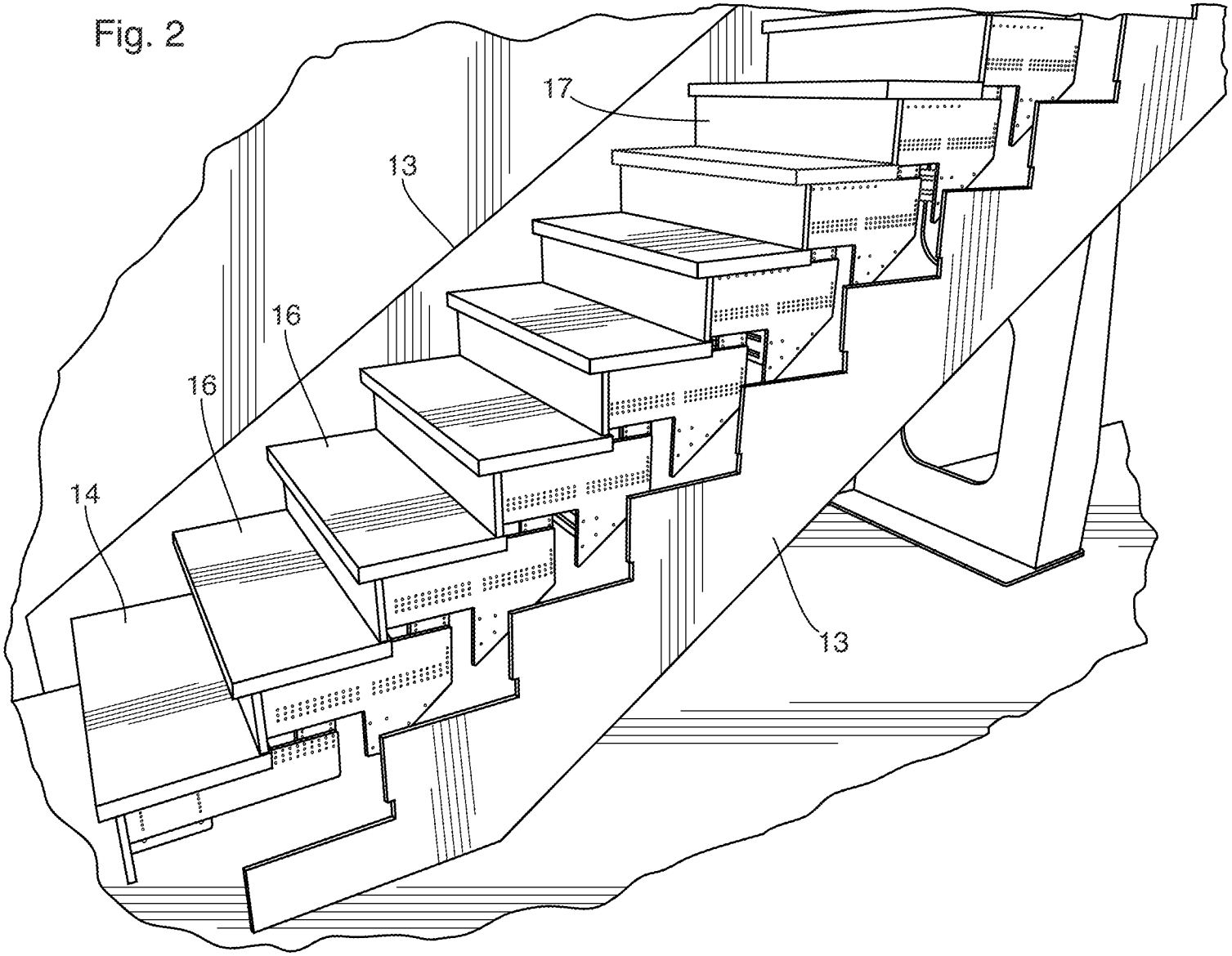
FIG. 2 is a perspective view of the modular staircase frame of FIG. 1 with removable treads and cladding.

The two opposing sets of laterally spaced blades 20, 22 are placed at a lateral distance from each other that may be selected by the user. In the embodiment shown in FIGS. 1 and 2, the lateral distance between the two opposing sets of laterally spaced blades 20, 22 is substantially equivalent to the width of the treads resting on the modular staircase frame 1.

In an alternative embodiment, the two opposing sets of laterally spaced blades 20, 22 may be placed close together, preferably at least 6" apart, in a "monolith" construction. In this alternative embodiment, the treads overhang the two opposing sets of laterally spaced blades 20, 22.

Depending on the aesthetic preference of the user, a staircase may also have risers 17 and additional cladding 13, which may cover the outside (shown in FIG. 2) and bottom (not shown) of the modular staircase frame 1.

Figure 6:
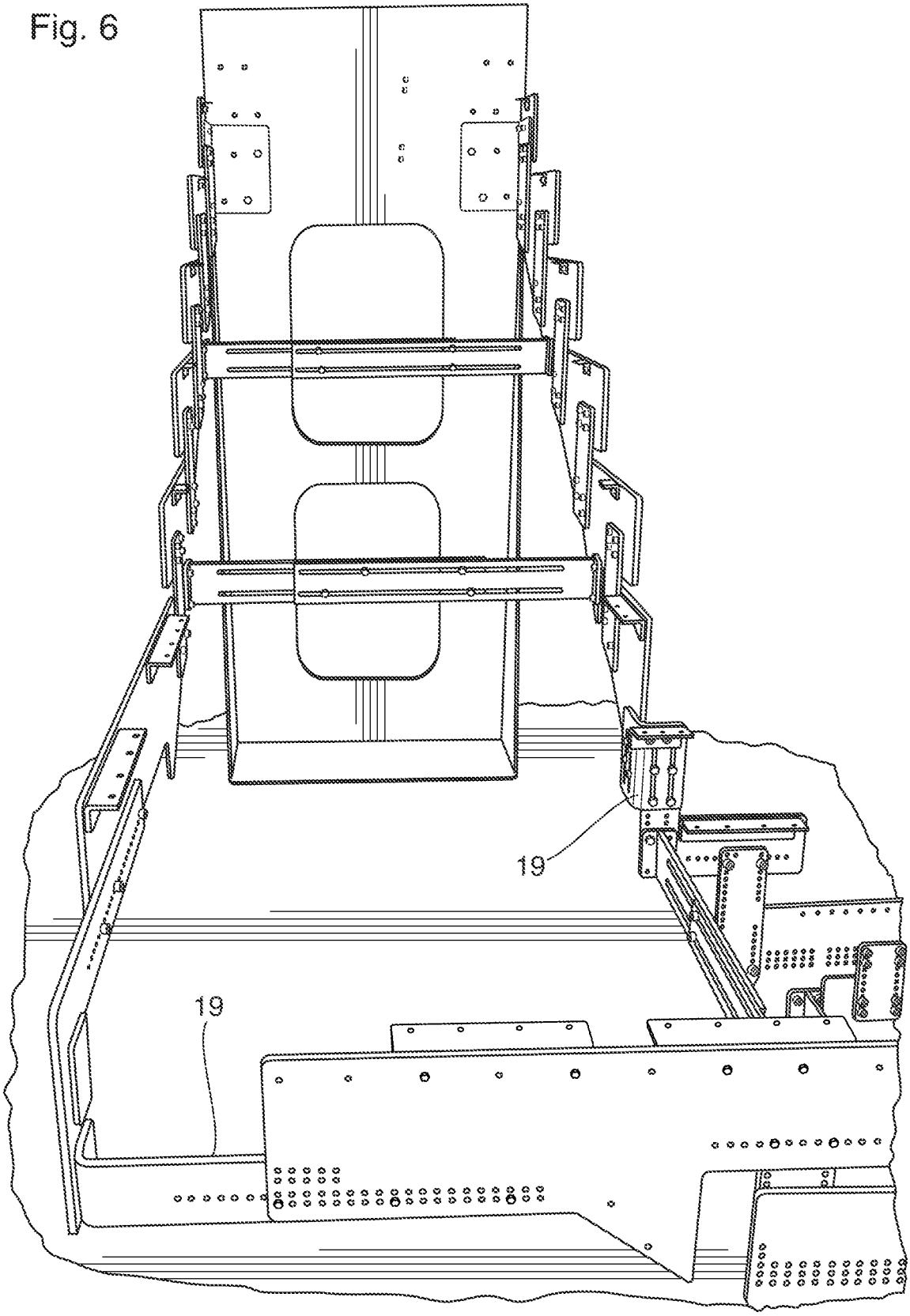
FIG. 6 is a front elevational view of the modular staircase frame shown in FIG. 5.
Figure 7:
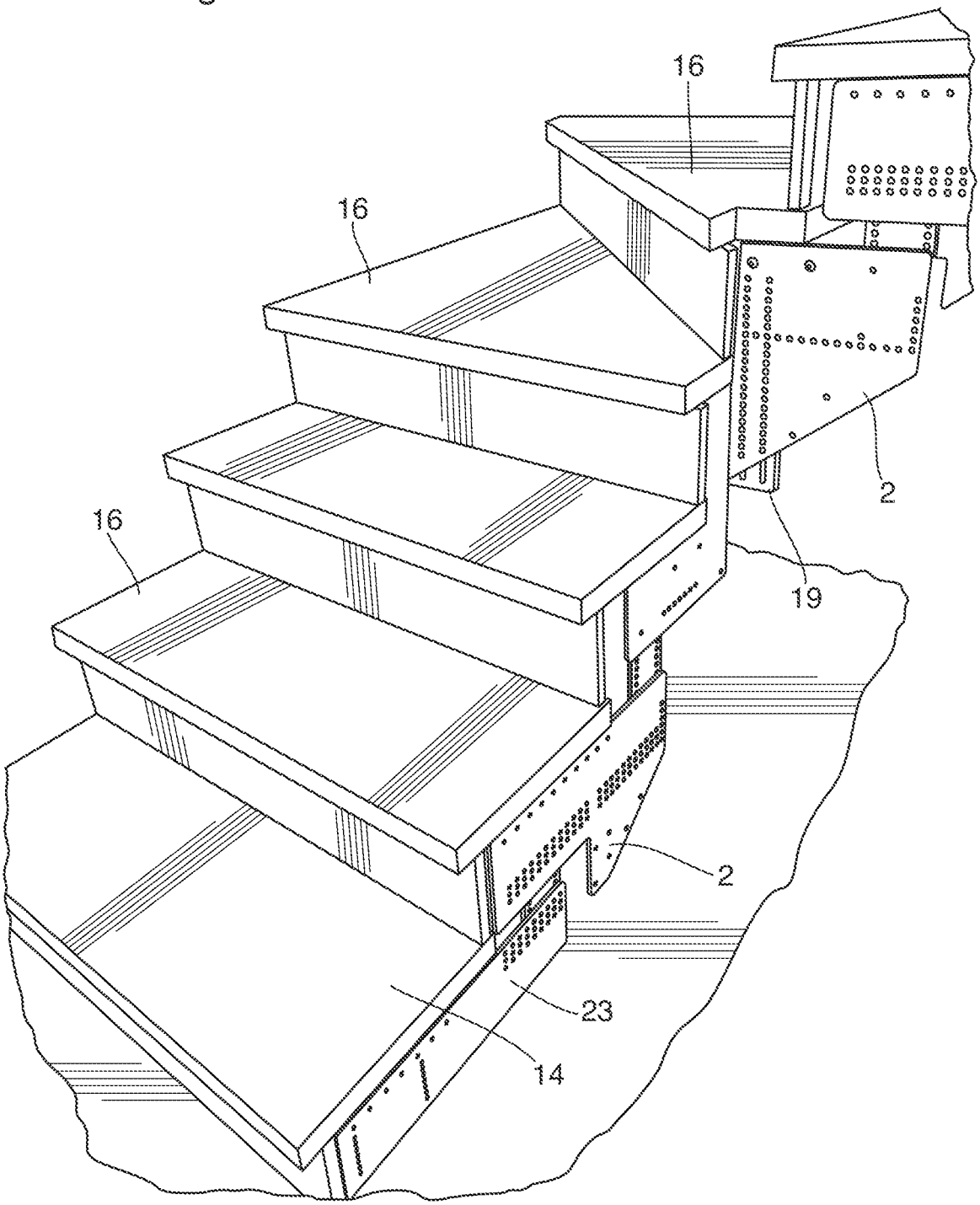
FIG. 7 is a perspective view of the modular staircase frame of FIGS. 5 and 6 with removable treads and risers attached.

The embodiment shown in FIG. 1 is a straight staircase between two floors. The present disclosure also contemplates a staircase that takes one or more turns. In the embodiment shown in FIGS. 5-7, each of the two opposing sets of laterally spaced blades 20, 22 further comprises at least one corner blade 19. The corner blade 19 connects two adjacent blades 2 around a turn that is preferably 90 degrees, but may be any suitable angle. The corner blades 19 and adjacent blades 2 may support two or more winder steps (as shown in FIG. 7), or a single landing.

The present disclosure also contemplates a method of construction of a modular staircase frame 1. As set out above, the modular staircase frame 1 comprises two opposing sets of laterally spaced blades 20, 22. In order to create the two opposing sets of laterally spaced blades 20, 22, a plurality of adjacent blades 2 are arranged in an ascending formation.

The first pair of opposing laterally spaced blades 23, each of which define a flange 8, are anchored to a first surface 9 Similarly, the final pair of opposing laterally spaced blades 10, each of which define a flange 26, are anchored to a second surface 11. The anchoring may be done using fasteners, or any other known method of anchoring a staircase frame to a surface.

Each adjacent blade 2, 10, and 23 is adjustably connected together in the manner described above to form the two laterally spaced ascending frame members of the modular staircase frame 1.

Although the invention has been described with reference to illustrative embodiments, it is to be understood that the invention is not limited to these precise embodiments. Numerous modifications, variations, and adaptations may be made to the particular embodiments of the invention described above without departing from the scope of the invention. The scope of the claims should not be limited by the preferred embodiments set forth in the examples, but should be given the broadest interpretation consistent with the description as a whole.

Immaterial modifications may be made to the embodiments described herein without departing from what is covered by the claims. The indefinite article "a" before a claim feature does not exclude more than one of the feature being present. Each of the individual features described here may be used in one or more embodiments and is not, by virtue only of being described here, to be construed as essential to all embodiments as defined by the claims.

The invention claimed is:

1. A modular staircase frame comprising:

a pair of laterally spaced first end blades, each laterally spaced first end blade having a plurality of openings for receiving a fastener, the pair of laterally spaced first end blades configured to anchor the modular staircase frame to a first base surface at a first height and to support a removable first end step;

a pair of laterally spaced second end blades that are longitudinally spaced from the pair of laterally spaced first end blades, each laterally spaced second end blade having a plurality of openings for receiving a fastener, the pair of laterally spaced second end blades configured to anchor the modular staircase frame to a second base surface at a second height and to support a removable second end step;

a plurality of pairs of laterally spaced intermediate blades disposed between the laterally spaced first end blades and the laterally spaced second end blades, each laterally spaced intermediate blade having a plurality of openings for receiving a fastener, and each pair of laterally spaced intermediate blades configured to support a removable intermediate step; and a plurality of connecting blades, each connecting blade having at least two spaced openings for receiving a fastener, wherein each laterally spaced first end blade is removably connected to an adjacent laterally spaced intermediate blade by aligning the plurality of openings of one of the plurality of connecting blades to at least one user-defined opening on the laterally spaced first end blade and at least one user-defined opening on the adjacent laterally spaced intermediate blade, and inserting a fastener through the plurality of openings, each laterally spaced second end blade is removably connected to an adjacent laterally spaced intermediate blade by aligning the plurality openings of one of the plurality of connecting blades to at least one user-defined opening on the laterally spaced second end blade and at least one user-defined opening on the adjacent laterally spaced intermediate blade, and inserting a fastener through the plurality of openings, and each laterally spaced intermediate blade is removably connected to an adjacent laterally spaced intermediate blade by aligning the plurality of openings of one of the plurality of connecting blades to at least one user-defined opening on each of the laterally spaced adjacent intermediate blades, and inserting a fastener through the plurality of openings, the modular staircase frame further comprising at least one stiffener extending between at least one of the pairs of laterally spaced intermediate blades, the at least one stiffener comprising two or more panel members, each panel member defining a longitudinal groove, wherein the at least one stiffener is adjustable to define a spacing between the at least one pair of laterally spaced intermediate blades by aligning the longitudinal grooves at a user-defined position and inserting a fastener through the longitudinal grooves.

2. The modular staircase frame of claim 1, wherein the modular staircase frame is assembled at a worksite.

3. The modular staircase frame of claim 1, wherein the pair of laterally spaced first end blades, the pair of laterally spaced second end blades, the plurality of pairs of laterally spaced intermediate blades and the plurality of connecting blades are made of a material selected from the group consisting of aluminum, PVC, fiberglass, carbon fiber, plexiglass, polycarbonate, aluminum alloys, and titanium.

4. The modular staircase frame of claim 1, wherein at least one of the connecting blades that connects laterally spaced adjacent intermediate blades is a corner blade.

5. The modular staircase frame of claim 4, wherein the corner blade connects adjacent laterally spaced intermediate blades around a turn between 30 degrees and 180 degrees.

6. The modular staircase frame of claim 4, wherein the corner blade connects adjacent laterally spaced intermediate blades around a 90-degree turn.

7. The modular staircase frame of claim 4, wherein the corner blade is configured to support one or more removable winder steps.

8. The modular staircase frame of claim 7, wherein the corner blade defines at least one flange for supporting the one or more removable winder steps.

9. The modular staircase frame of claim 7, wherein the removable winder step is temporary.

10. The modular staircase frame of claim 4, wherein the corner blade is configured to support a removable landing.

11. The modular staircase frame of claim 10, wherein the corner blade defines at least one flange for supporting the removable landing.

12. The modular staircase frame of claim 10, wherein the removable landing is temporary.

13. The modular staircase frame of claim 1, wherein each laterally spaced first end blade defines at least one flange for supporting the removable first end step, each laterally spaced second end blade defines at least one flange for supporting the removable second end step, and each laterally spaced intermediate blade defines at least one flange for supporting one of the removable intermediate steps.

14. The modular staircase frame of claim 1, wherein the pair of laterally spaced first end blades, the pair of laterally spaced second end blades, the plurality of laterally spaced intermediate blades and the plurality of connecting blades are made of steel.

15. The modular staircase frame of claim 1, wherein each laterally spaced first end blade defines at least one flange for supporting the removable first end step, each laterally spaced second end blade defines at least one flange for supporting the removable second end step, and each laterally spaced intermediate blade defines at least one flange for supporting one of the removable intermediate steps.

16. The modular staircase frame of claim 1, wherein the removable first end step, the removable second end step, and each of the removable intermediate steps are temporary.

17. The modular staircase frame of claim 1, further comprising:

a removable first end step supported by the pair of laterally spaced first end blades, a removable second end step supported by the pair of laterally spaced second end blades, a plurality of removable intermediate steps supported by the plurality of pairs of laterally spaced intermediate blades, and a plurality of removable risers disposed between the removable first end step and an adjacent removable intermediate step, between the removable second end step and an adjacent removable intermediate step, and between each of the adjacent removable intermediate steps.

* * * * *